US005364313A

United States Patent [19]

Nickelson

[11] Patent Number: 5,364,313

[45] Date of Patent: Nov. 15, 1994

[54] CHILD ENTERTAINMENT DEVICE

[76] Inventor: David Nickelson, P.O. Box 68, 21279 Olinda Tr. N., Scandia, Minn. 55073

[21] Appl. No.: 120,047

[22] Filed: Sep. 13, 1993

[51] Int. Cl.[5] ..... A63G 1/32

[52] U.S. Cl. ..... 472/135; 472/106; 472/137

[58] Field of Search ..... 472/135, 106, 137

[56] References Cited

U.S. PATENT DOCUMENTS

| | | | |
|---|---|---|---|
| 1,537,686 | 5/1925 | Lynn . | |
| 1,660,130 | 2/1928 | Kolos . | |
| 2,541,586 | 2/1951 | Jones | 272/44 |
| 2,720,395 | 10/1955 | Pansko | 472/135 |
| 3,062,542 | 11/1962 | Evancha | 272/57 |
| 3,292,924 | 12/1966 | Wormser et al. | 272/54 |
| 3,339,920 | 9/1967 | Moritz | 472/135 |
| 3,485,493 | 12/1969 | Pitkanen | 272/1 |
| 3,547,435 | 12/1970 | Scott | 272/60 |
| 3,595,569 | 7/1971 | Holte | 472/106 X |
| 3,709,486 | 1/1973 | Haroski | 272/30 |
| 3,761,084 | 9/1973 | Dieckmann | 472/135 |
| 3,944,654 | 3/1976 | Moore | 272/60 |
| 4,378,112 | 3/1983 | Goldstein | 272/11 |
| 4,474,369 | 10/1984 | Gordon | 272/3 |
| 4,645,197 | 2/1987 | McFee | 272/65 |
| 4,796,884 | 1/1987 | Ely et al. | 272/113 |

*Primary Examiner*—Carl D. Friedman
*Assistant Examiner*—Beth A. Aubrey
*Attorney, Agent, or Firm*—Jacobson & Johnson

[57] ABSTRACT

A child's amusement device having a torsible beam with the torsible beam having a child-support surface for a child to sit or stand on with pivotal supports spaced about and supporting the periphery of the torsible beam, with the torsible beam having sufficient rigidity to remain in a fixed position when no external force is applied to the child-support surface, and the torsible beam having sufficient resiliency so that when an external force deflects the torsible beam, the torsible beam flexes and twists in response thereto, causing the torsible beam to oscillate about the pivotal supports and thereby provide an amusement ride for a child thereon.

12 Claims, 2 Drawing Sheets

CHILD ENTERTAINMENT DEVICE

FIELD OF THE INVENTION

This relates generally to a playground apparatus, and, more specifically, to a playground apparatus on which a child can sit or ride.

BACKGROUND OF THE INVENTION

Children generally enjoy activities involving physical motion. Items such as teeter-totters remain popular because children can propel themselves and create their own motion or rides. The present invention is a child-amusement device in which a child can, if desired, merely sit on the device and talk with friends, or if he or she wants a ride, the child can move up and down on a portion of the amusement device, thereby causing the amusement device to oscillate and carry him or her back and forth providing a ride.

DESCRIPTION OF THE PRIOR ART

U.S. Pat. No. 2,541,586 shows a device which provides an undulating motion; however, it requires a cart to follow a track U.S. Pat. No. 3,547,435 shows balancing beams for a child to walk on within a climber.

U.S. Pat. No. 4,474,369 shows a ring-like jogging track which contains trampoline-like material to absorb energy as a person runs around the track.

U.S. Pat. No. 3,944,654 shows a balancing beam arranged in a square with four pedestals located on the comers of the unit to permit a person to walk around the unit.

U.S. Pat. No. 4,378,112 shows beam with a flexible tubes connected to each of its ends to permit up and down motion.

U.S. Pat. No. 3,709,486 shows an offset see-saw.

U.S. Pat. No. 1,537,686 shows a device for producing wave-like action with reciprocating platforms.

U.S. Pat. No. 3,292,924 shows a see-saw supported by four coil springs.

U.S. Pat. No. 3,062,542 shows a balancing exercising device.

U.S. Pat. No. 1,660,130 shows a gymnastic appliance having a general shape of a figure 8.

U.S. Pat. No. 4,645,197 shows a bouncing board exerciser which uses springs and the weight of a person.

U.S. Pat. No. 4,796,884 shows a playground apparatus with balancing beams for children to walk on.

SUMMARY OF THE INVENTION

Briefly, the invention comprises a children's amusement device, having a torsible beam with the torsible beam having a child-support surface for a child to sit or stand on, with pivotal supports pivotally supporting the torsible beam. The supports are spaced about the periphery of the torsible beam, with the torsible beam having sufficient rigidity to remain in a fixed horizontal position when no external force is applied to the child-support surface, and the torsible beam having sufficient resiliency so that when an external force bends the torsible beam, the entire torsible beam flexes and twists in response, causing the torsible beam to oscillate about the pivotal supports and thereby provide a ride for a child thereon.

DESCRIPTION OF THE PREFERRED EMBODIMENT

Figure 1:
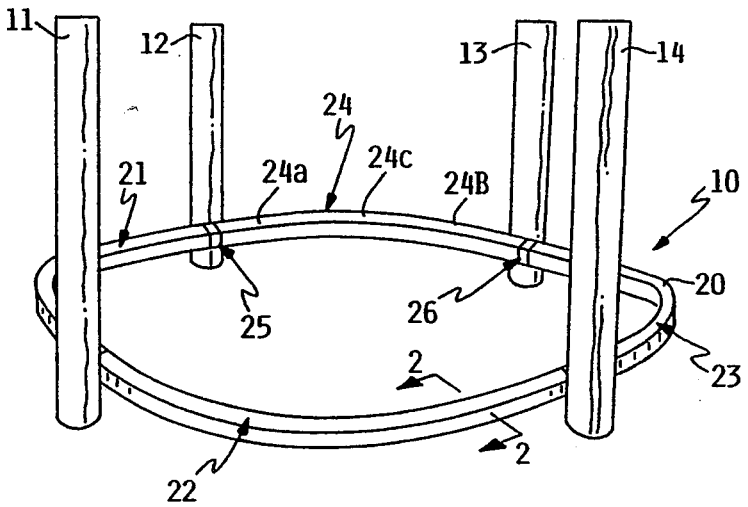
FIG. 1 is a perspective view of my child-amusement device.

FIG. 1 reference numeral 10 generally identifies my child-entertainment device. The child-entertainment device comprises a continuous torsible beam 20 located interior of and pivotally supported by a first upright post 11, a second upright post 12, a third upright post 13 and a fourth upright post 14. Torsible beam 20 has four segments: a first segment 21 located between posts 11 and 12; a second segment 22 located between posts 11 and 14; a third segment 23 located between posts 13 and 14; and a fourth segment 24 located between posts 12 and 13. Reference numeral 25 identifies the pivotal support mechanism attached to beam 20 and to post 12, and, similarly, reference numeral 26 identifies an identical pivotal support mechanism attached to beam 20 and to post 13. Identical pivotal support mechanisms are connected to posts 11 and 14 and to beam 20. The posts support the torsible beam 20 and also provide support for a child to hold on to while standing on beam 20.

Figure 2:
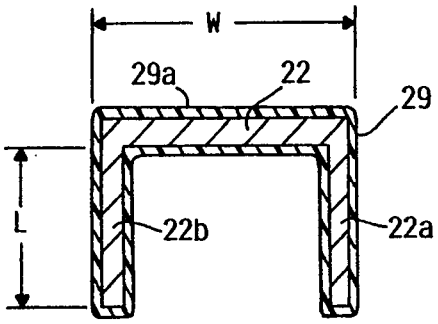
FIG. 2 is a cross-sectional view taken along lines 2—2 of FIG. 1.

Torsible beam 20 is shown in cross section in FIG. 2 and comprises a generally U-shaped member 22 made of steel or the like, having a first leg **22*a* and a second leg 22*b*. Located around beam 20 is a protective, polymer plastic layer 29. The use of a polymer plastic layer performs a dual purpose. It provides a soft, clean surface for a child to sit or stand on, and it protects the beam from oxidation. In the preferred embodiment a layer 29 of about ⅛ inch thick PVC (polyvinylchloride) extends around and encapsulates the U-shaped beam 22. Beam 22 has a top surface width denoted by "W" and the length of the legs by "L." Typically, "W" may be approximately five inches and "L" may be approximately four inches. A seating or standing surface on top of beam 22 is identified by reference numeral 29*a***.

Figure 5:
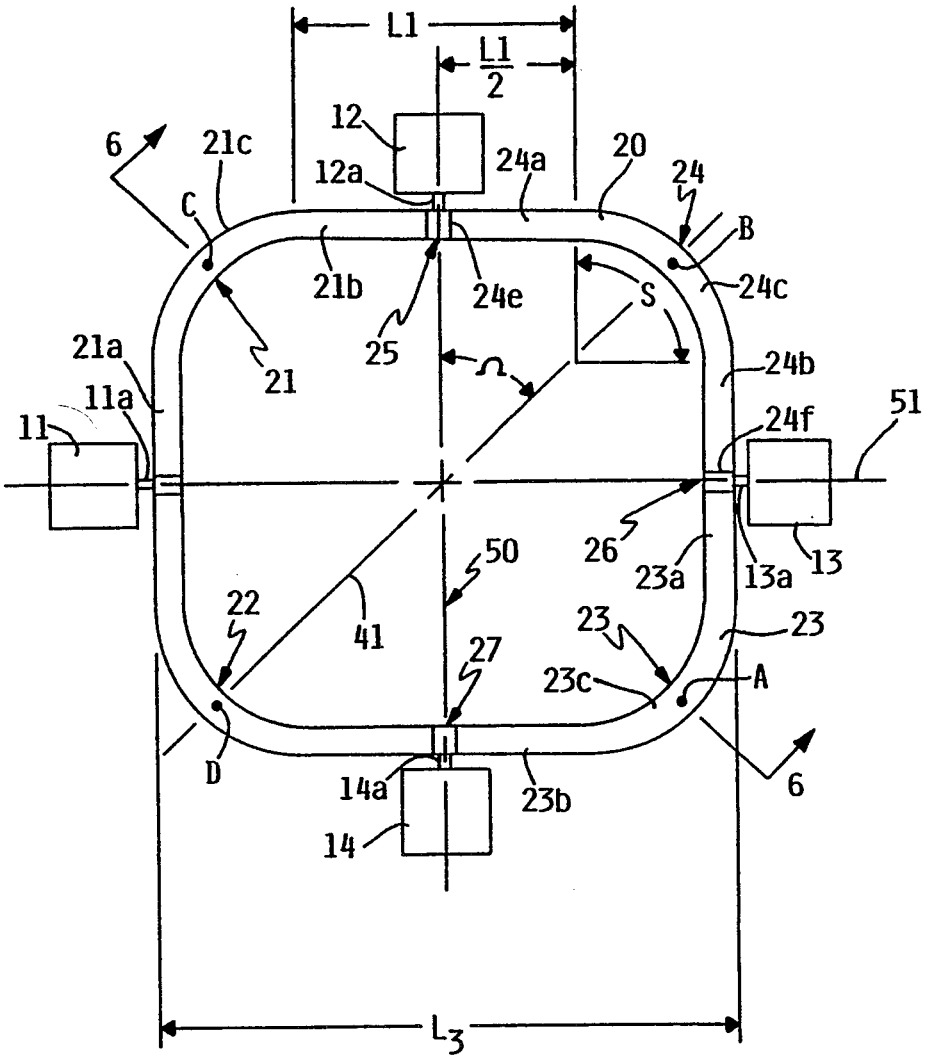
FIG. 5 is a top view of my child-amusement device.

FIG. 5 is an overhead view of my entertainment device 10 showing that torsible beam 20 has a generally overall geometric appearance of a square member with rounded comers. FIG. 5 shows that torsible beam 20 is connected to and pivotally supported by post 11 through a pivot member **11*a*, by post 12 through a pivot member 12*a*, by post 13 through a pivot member 13*a* and by post 14 through a pivot member 14*a*. In the preferred embodiment the adjacent pivot members are substantially perpendicular to each other to restrain the beam so the beam flexes and twists when oscillated about the pivot members. In the embodiment shown torsible beam 20 comprise a contineous loop. As an alternate embodiment torsible beam 20** could form an open loop with the torsible beam restrained by adjacent pivot members located substantially perpendicular to each other to prevent the torsible beam from moving unless the torsible beam is forced to flex and bend with respect to the pivot members.

Figure 3:
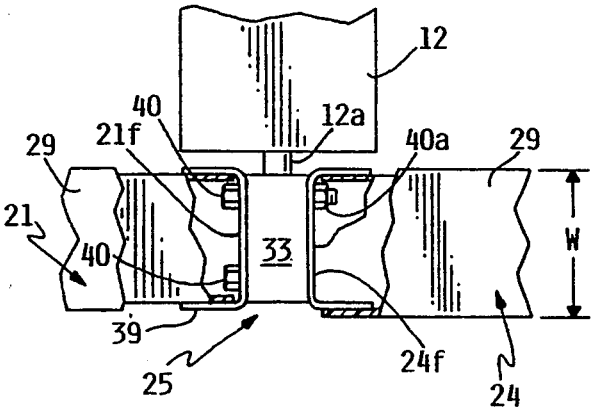
FIG. 3 is a partial sectional view showing the pivot mechanisms of my child-amusement device.
Figure 4:
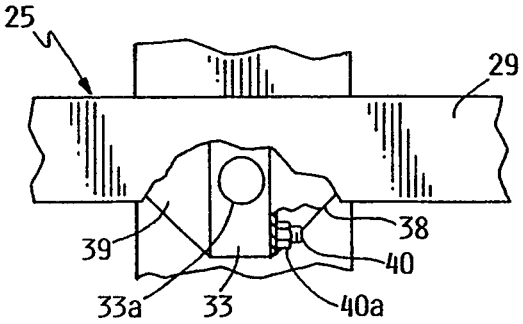
FIG. 4 is a front, partial sectional view showing the pivot mechanism of my child-amusement device.

Pivot members 11*a*, 12*a*, 13*a*, and 14*a* are identical and, hence, only one will be described herein. FIG. 3 and FIG. 4 shows pivot member 12*a* comprising a cylindrical metal pin extending laterally and horizontally outward from post 12 and pivotally engaging a cylindrical opening in support block mechanism 25 that joins end member 21*f* of segment 21 to end member 24*f* of segment 24. In the embodiment shown end members 21*f* is welded to segment 21 and end member 24*f* is welded to segment 24 to form an integral end construction. Since each of the mechanisms which connects the portions of torsible beam 20 are identical, only one will be described herein.

FIG. 3 shows a pivot block 33 connects torsible beam segment 21 with torsible beam segment 24 through a first bracket 39 secured to end member 21*f* and a second bracket 38 secured to end member 24*f* through bolts 40 having a nut 40 *a* .

The pivot block 33 and connection mechanism are for purposes of assembly and manufacture so the torsible beam does not have to be made in a single unit. However, if desired, torsible beam 20 could be made in a single, continuous beam without interruption, thus eliminating the need for separate pivot block mechanisms.

To understand the operation of the torsible beam 20, refer to FIG. 5. Reference numeral 50 identifies a first axis extending centrally through pivot members 12*a* and 14*a* while reference numeral 51 identifies a second axis extending perpendicularly to axis 50 and centrally through pivot members 11*a* and 13*a*. A diagonal line 41 forms an angle, omega, of 45 degrees with axis 50 and 51. That is, line 41 dissects torsible beam 20 at points B and D. Point B is midway between pivot members 12*a* and 13*a*, and, similarly, the point designated by D on torsible beam 20 is midway between pivot members 11*a* and 14*a*. Since each of the segments of torsible beam 20 are identical, only one segment and its adjoining segment will be described herein.

Segment 24 comprises a straight section 24*a*, a curved section 24*c* and a further straight section 24*b*. Similarly, segment 21 comprises a straight section 21*a*, a curved section 21*c* and a straight section 21*b*. Sections 21*b* and 24*a* are joined together by pivot block 25 and form a straight, generally stiff section of length indicated by $L_1$. Each of the curved connecting segments 21*c*, 22*c*, 23*c*, and 24*c* extends a distance S.

Figure 6:
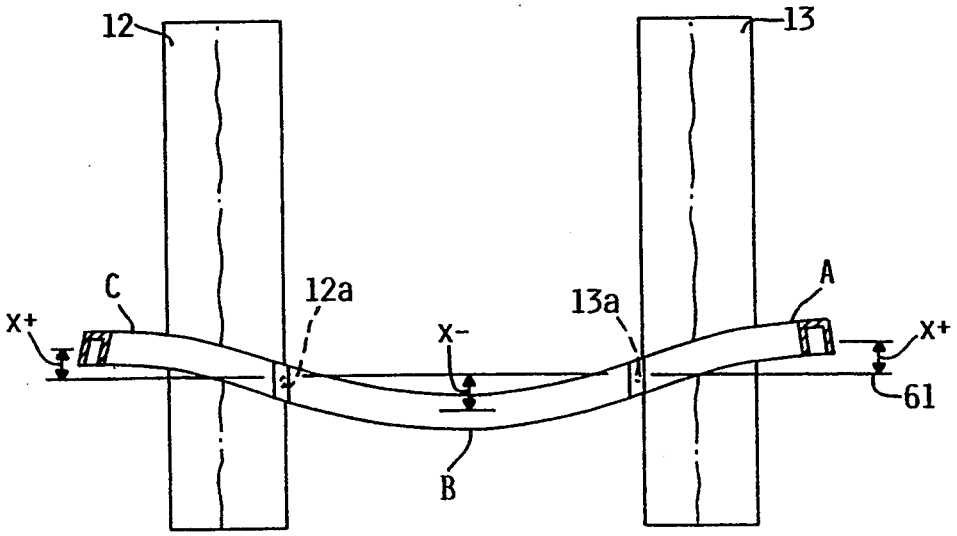
FIG. 6 is a sectional view taken along lines 6—6 of FIG. 5 showing the twisting and bending of my torsible beam in response to external forces.

To understand the operation of the invention which is dependent upon torsible beam 20 having the flex capacity to twist in response to an outside force and the resilient capacity to generate a restoring force in response to the flexing and twisting of torsible beam 20, refer to FIGS. 1, 5 and 6.

FIG. 1 shows torsible beam 20 in the relaxed position with support members spaced about the periphery of torsible beam 20. Torsible beam 20 is located in a horizontal plane which is about a foot above the ground. While the torsible beam 20 could be placed higher, it is preferable to have the beam close to the ground, so if a child accidentally falls off the beam, the distance is minimal, thus preventing the child from being injured by the fall.

FIG. 5 shows torsible beam 20 held in a fixed position by four pivot members 11*a*, 12*a*, 13*a* and 14*a* that are spaced at about 90-degree intervals around the periphery of torsible beam 20. Although, torsible beam 20 is restrained from vertical movement by the pivotal support members, torsible bean 20 has sufficient flexibility and resiliency, so that if a sufficient downward force is applied to a segment of the beam located between the pivot support members, the other segments of the beam flex and pivot about the pivot members 11*a*, 12*a*, 13*a* and 14*a*. That is, torsible beam 20 although restrained from moving as a unit contains sufficient torsibility to allow the segments of beam 20 to both flex and twist in response to a child jumping up and down thereon and sufficient spring action to drive both torsible beam 20 and the child in an up and down motion.

FIG. 6 shows a cross-sectional view of my child-amusement device showing posts 12 and 13 and torsible beam 20 in section. To illustrate the flexing and bending of torsible beam 20, a force has been placed on the curved segment at point B causing a downward deflection of point B a distance X− below a horizontal reference plane 61. Because torsible beam 20 is a continuous member and is made of resilient material such as steel, a downward deflection of curved segment 24 at point B transfers the forces to the other portions of the beam to produce a corresponding upward deflection X+ at points A and C of torsible beam 20. It should be pointed out that the forming of a continuous loop which is normally held in a horizontal position through pivot members restrains the torsible beam 20 from moving up and down in certain portions of the beam yet permits other portions of the torsible beam 20 to flex and twist in a manner which is not fully understood. For example, as segment 24 flexes and twists as it moves down, the segment 22 on the opposite side flexes and twists in the same direction to allow downward movement of segment 22. Similarly, the opposite portions of segments 21 and 23 also twist and flex in an opposite direction in response to the motion of segment 24. Since the torsible beam 20 is restrained from vertical motion at the pivot support members 11*a*, 12*a*, 13*a* , and 14*a*, the portions of the beam intermediate of the support members must twist or flex to absorb the forces; however, points A, B, C, and D, while moving up and down, remain in a neutral nontwisting mode while the portions of the segments on opposite sides of each of the points flex and twist in opposite directions.

I have found by having a torsible U-shaped steel beam 20 of sufficiently large diameter, typically 8–10 feet, I provide a sufficiently long lever arm about the pivot supports 11*a*, 12*a*, 13*a*, and 14*a* so the weight of a child moving up and down causes torsible beam 20 to flex and twist. I have found the spring-like action of torsible beam 20 coupled with the inertia of the torsible beam 20 is sufficient to generate a counter-force that moves both the beam and the child up and down on the beam, thereby providing a ride for the child.

The result is that children can create their own rides through the manipulation of their weights on the torsible beam 20. In addition, the downward flexing and the spring like action of the beam combine with the inertia of the child and the inertia of the ting to create a sustainable oscillation of the entire beam 20 with very little effort. The oscillation causes a first portion or segment of the beam to move up and a second opposite portion or segment of the beam to also move up. Correspondingly, the intermediate portions or segments connected to the first portion and the second portion move down with the intermediate segments driven by the motion of the first and second segments. Consequently, a child can stand or jump on the torsible beam and ride the up-and-down motion as the beam twists and turns in response to the forces thereon.

While I have used a steel U-shaped beam other shaped resilient members susceptible to flexing and twisting could also be used. The size of the beam can be determined by the distance the effective lever arms extend from the pivot members and the weight of the children that will operate the device. I prefer to use stiff, but resilient materials, that will have a normal deflection of about a foot, however, if greater or lesser amplitude of oscillation the beam could be made stiffer or more flexible.

EXAMPLE

A child's amusement device was made from a steel beam with the distance $L_3$ about eight feet. The torsible beam had a U-shaped cross section with the top surface width W about four inches and the legs having a length L of about three inches. The curved segment portions had a radius of about 30 inches with the distance $L_1/2$ about two feet. The thicknesses of the steel beam was about 3/16 of an inch. A ⅛ inch thick layer of PVC covered the entire beam and the pivotal supports to cover any sharp edges on the beam as well as provide a clean surface for a child to sit or stand on. Four pivotal members supported the torsible beam in a horizontal position. When a child shifted his or her weight while on the beam portions of the beam further from the pivotal supports would oscillate upward with an amplitude of over a foot.

I claim:

1. A child's amusement device comprising:

a torsible beam having sufficient rigidity to remain in a rigid condition when no external force is applied, said torsible beam having sufficient resiliency so that the entire torsible beam can flex and twit in response to an external force on said torsible beam, said torsible beam having a child-support surface;

a plurality of pivotal supports carrying said torsible beam, said plurality of pivotal supports spaced about said torsible beam, said pivotal supports coacting to restrain said torsible beam from pivoting motion about the pivotal supports unless an external force is applied to said child-support surface which is sufficient to both flex and twist the torisble beam, said torsible beam having sufficient flexibility and resiliency so that when an external force deflects a portion of said torsible beam, other portions of said torsible beam flex and twist in response thereto causing the other portions of the torsible beam to flex and twist as the torsible beam oscillates about the pivotal supports to thereby provide a ride for a child located thereon.

2. The child's amusement device of claim 1 including at least four pivotal supports.

3. The child's amusement device of claim 1 wherein said pivotal supports are equally spaced around said torsible beam.

4. The child's amusement device of claim 1 wherein said torsible beam comprises four segments joined to each other to form a closed ring.

5. The child's amusement device of claim 1 wherein said torsible beam is covered with a polymer plastic.

6. The child's amusement device of claim 1 wherein said torsible beam has a generally U-shaped cross section.

7. The child's amusement device of claim 1 wherein said torsible beam has a general square shape with rounded comers.

8. The child's amusement device of claim 1 the pivotal supports includes four posts having pivot bars therein for pivotally engaging said torsible beam.

9. The child's amusement device of claim 1 wherein said torsible beam is made of steel.

10. The child's amusement device of claim 1 wherein said torsible beam comprises a continuous loop.

11. The child's amusement device of claim 1 including uprights suspending the torsible beam in a horizontal plane about a foot above the ground.

12. A device for entertainment of children comprising:

a first upright;

a first pivot member extending outward from said first upright member;

a second upright member;

a second pivot member extending outward from said second upright member;

a third upright member;

a third pivot member extending outward from said third upright member;

a fourth upright member;

a fourth pivot member extending outward from said fourth upright member;

a continuous torsible beam, said torsible beam having a top surface sufficiently wide for a child to stand or sit on, said torsible beam having a first pivotal support for engaging said first pivot member; said torsible beam having a second pivotal support for engaging said second pivot member, said torsible beam having a third pivotal support for engaging said third pivot member, said torsible beam having a fourth pivotal support for engaging said fourth pivot member,said torsible beam forming a closed ring like loop with said pivotal supports coacting to restrain said torsible beam from an up and down motion, said torsible beam having sufficient torsibility so that a downward deflection of a portion of said torsible beam beam creates an upward deflection in a further portion of the torsible ring located diagonally opposite of said first portion of said torsible beam, with said torsible beam characterized by having sufficient spring action and inertia so that when the first portion of torsible beam is deflected about the pivotal supports the other portions of the torsible beam located between said pivotal supports twist and bend to allow the torsible beam to oscillate in response thereto to carry a person person sitting or standing on the torsible beam in an up and down motion.

* * * * *